United States Patent [19]

Rastelli

[11] Patent Number: 4,457,140

[45] Date of Patent: Jul. 3, 1984

[54] MODULAR REFRIGERATION UNIT AND CABINET SYSTEMS THEREWITH

[75] Inventor: Agostino A. Rastelli, Grove City, Ohio

[73] Assignee: Leitner Corporation, Ohio

[21] Appl. No.: 380,708

[22] Filed: May 21, 1982

[51] Int. Cl.[3] ..... F25D 23/12

[52] U.S. Cl. ..... 62/261; 62/285; 62/298; 62/440; 312/236

[58] Field of Search ..... 62/261, 298, 299, 302, 62/440, 285; 312/214, 236

[56] References Cited

U.S. PATENT DOCUMENTS

| | | | |
|---|---|---|---|
| 2,973,631 | 3/1961 | Adkins | 62/298 |
| 3,031,862 | 5/1962 | Sherron | 62/298 |
| 3,099,914 | 8/1963 | DeWitt et al. | 62/276 |
| 3,182,467 | 5/1965 | Beckwith | 62/276 |
| 3,316,731 | 5/1967 | Quick | 62/278 |
| 3,650,122 | 3/1972 | Lieberman | 62/298 |
| 3,712,078 | 1/1973 | Maynard et al. | 62/298 |

OTHER PUBLICATIONS

Reed Industries, Victor Division, Stone Mountain, Georgia, "Visi-Kool Refrigerated Food Display Cases."

Leitner Division of Reed Industries Inc., Stone Mountain, Georgia, "Pizza and Sandwich Preparation Table."

Reed Industries, Inc., Hagerstown, Maryland, Drawing No. L-00174.

*Primary Examiner*—Ronald C. Capossela

*Attorney, Agent, or Firm*—Porter, Wright, Morris & Arthur

[57] ABSTRACT

A modular refrigeration unit which is independently removable from an equipment zone in a foodstuffs refrigerator is described. The modular refrigeration unit integrally includes compressor, condenser, evaporator, metering means and means for connecting said components in the relationship of a refrigeration cycle, and an air circulating means to provide a recirculating flow of air between the refrigeration unit and the food zone of the refrigerator. The modular unit may be used in a system of standardized refrigerators at multiple installations at separate locations, in which the refrigeration system of each unit is separately removeable from each unit and interchangeable with the others. Service and maintenance of the refrigerator is facilitated and useable storage space and sanitation in the food zone is increased.

4 Claims, 7 Drawing Figures

MODULAR REFRIGERATION UNIT AND CABINET SYSTEMS THEREWITH

FIELD OF THE INVENTION

This invention relates to refrigeration systems typically employed in institutional and commercial food preparation and preservation apparatus.

BACKGROUND OF THE PRIOR ART

In the prior art, free standing refrigerator cabinets are well known. One commercial variety includes a separate food preparation area on the top and is generally useful in pizza, salad and sandwich preparation activities in a commercial/institutional environment. Such units typically provide a refrigerator cabinet with front access doors and a chilled section at the top of the unit in which condiment trays or other such food containers are maintained in a refrigerated environment, yet allow convenient access to the food therein.

The refrigeration system in such a unit includes a conventional compressor, condenser, evaporator and metering device. Typically the refrigeration system is arranged in the cabinet unit so that the evaporator unit, with air circulating fans is included within the refrigeration cabinet, in a central space in the volume thereof, to cool and circulate the air within the cabinet, and to direct refrigerated air to the condiment trays if such a feature is provided in conjunction with the refrigerator cabinet. In this configuration, the compressor and condenser components of the refrigeration system are separately installed at a distance from the evaporator unit and its associated fans within the refrigerator cabinet; lengths of tubing are required to connect together these elements of the refrigeration system.

Disadvantages with this variety of prior art system include the fact that the presence of the evaporator and air circulating fans within the refrigeration area reduces the useful food storage space available within the refrigerator cabinet. Further, multiple supplemental fans may be required for air circulation within the food storage area, and to direct refrigerated air to the condiment trays at the food preparation area on the top of the unit. The tubing connecting to the evaporator unit is subject to acid corrosion by reason of vapors or drippings from food stored such as salad dressing or the like. Also circulating air absorbs food moisture, resulting in a degree of food dehydration; and, the evaporator unit is also subject to condensate build-up, requiring that an electrically heated condensate evaporator or separate condensate drain be provided, adding to overall manufacturing costs and/or increasing the lifetime energy use cost of the refrigerator—as well as presenting possible sanitation problems if regular and careful maintenance and cleaning is not provided.

OBJECTS OF THE INVENTION

It is an object of the invention to provide a refrigeration system in which a modular unit separately incorporates conventional elements of a refrigeration system (compressor, condenser, evaporator, meter, and fans) in an independent unit which is located outside of, but adjacent to the refrigeration area in a free standing refrigerator cabinet. In this manner, the modular unit provides recirculation of cooled air in the refrigerated area. An advantage achieved, in contrast with prior refrigeration systems, is that the modular system is less expensive, and dispenses with the need in the refrigerated area for the separate evaporator and fans, connecting tubing, condensate drain and/or condensate evaporator which have heretofore been located therein in conventional refrigerator systems. Thus, space available for food storage in the refrigeration area is increased and costs and operating difficulties incident to the separation of components of the refrigeration system are reduced.

It is also an object of the invention to provide an overall refrigeration system which is easily maintained. In this regard, a self-contained, and independent, modular refrigeration unit is provided separately from the refrigeration area of the cabinet. Periodic maintenance or emergency service is facilitated because the modular unit containing all the elements of the refrigeration system is easily and separately removable from the overall unit. The modular refrigeration unit is wholly independent of the food zone of the refrigerator, and may be removed and another substituted in its place. Hence, a breakdown in the refrigeration system will not necessarily result in taking the refrigerator cabinet out of service, since modular units are interchangeable; a substitute unit can be provided during the period of service time. Thus, it is a further object of this invention to provide a system of standardized refrigeration units which may be utilized at multiple installations at separate locations, in which each unit is separately removeable from the refrigerator cabinet, and interchangeable with the other. Hence, service need not be done "on site", but rather a service facility for an overall system may be centrally located, resulting in a savings of travel time for service persons and a reduction of out of service equipment within the system.

A further object of the unit is to provide a commercial duty refrigerator with a recirculating air system that it is energy efficient and requires fewer BTU per hour to achieve the same temperature as a conventional unit. The unit does not require a condensate evaporator; the hot gas return line in the refrigeration cycle of the unit, in combination with heat from the condenser, is used to evaporate condensate. In this regard, sanitation is improved since water drippings will not collect within the refrigeration cabinet where food is maintained. Similarly acid droppings or food vapors which may corrode tubing in conventional systems will not reach the modular unit of the present system because mechanical equipment is not present in the food refrigeration zone.

It is also an object to provide a condiment table used in pizza, sandwich and salad preparation in a configuration, in which cooled air is recirculated in the food zone and the principal porton of cooling capacity is initially directed to cool a condiment pan and the remaining portion of capacity is directed to the confined refrigerator zone in the recirculation system.

Further objects of the invention are to provide a refrigeration unit in which:

(1) the blower fans and evaporator coil are mounted inside a modular housing together with every other component necessary in the refrigerator system, thereby allowing increased storage area for foodstuffs in the refrigerator cabinet;

(2) the refrigeration zone is free of mechanical equipment, is easy to clean and the overall unit has an attractive appearance;

(3) condensation drippings over food are eliminated since the blower fans and evaporator coil are not within the food storage area and in which refrigeration and electric lines are not located within the food refrigeration zone;

(4) a built-in condensate evaporator is provided which utilizes combined heat energy of the refrigeration system and does not require a separate electrical heater or outside drain; and (5) the removal of simple fasteners allows the refrigeration unit to slide for removal to facilitate cleaning and service.

These and other objects of the invention are more particularly explained by reference to the following description of the preferred embodiment, taken in conjunction with the drawings in which:

DESCRIPTION OF THE PREFERRED EMBODIMENT

Figure 1:
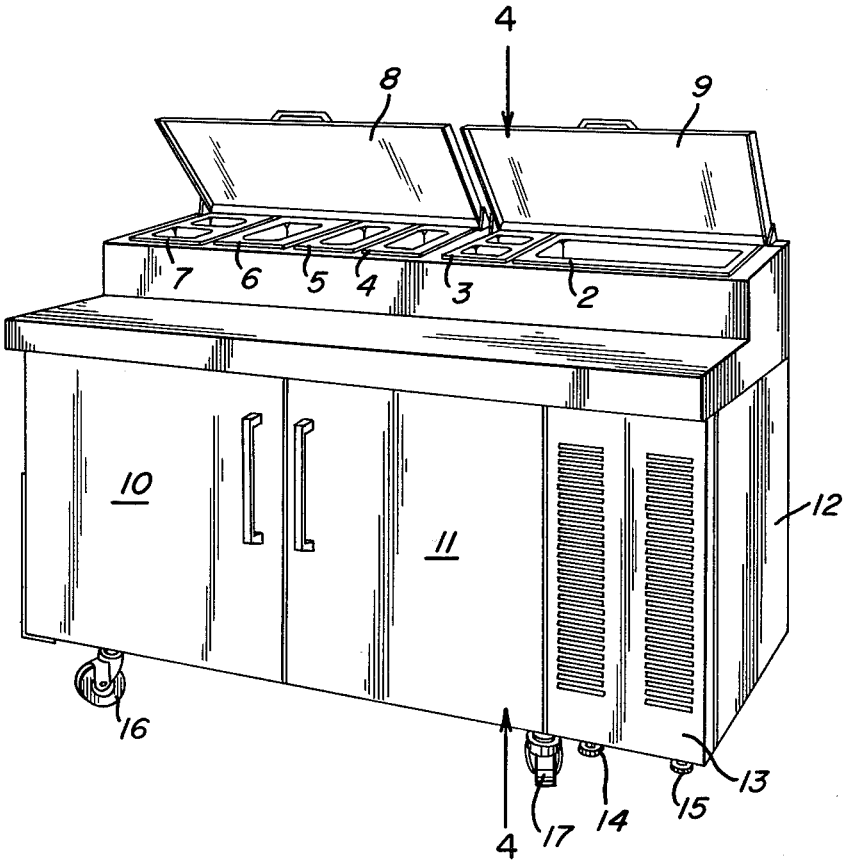
FIG. 1 is a front view in perspective of a refrigerator, useful as a pizza, sandwich, salad, or other food, preparation table including a condiment tray, embodying the system of the invention.

FIG. 1 shows a food preparation refrigerator table employing a modular refrigeration unit of the invention. In the refrigerator table of FIG. 1, there is shown a work surface area 1, condiment trays and pans of various sizes, 2–7, the lower portions of which are maintained in a refrigerated environment in the apparatus. Hingeable lids 8 and 9, or other top enclosures are conventionally provided for the condiment trays. Cabinet doors 10 and 11, with suitable opening grips, open to the principal refrigerated food storage zone of the unit and the modular refrigeration unit of the invention is provided adjacent the refrigeration zone, in a separate equipment zone, as indicated at 12. A vented front panel 13 for the refrigeration unit is securely maintained by thumb screws 14 and 15; or other fastening means. The entire table is mounted on casters, such as are shown at 16 and 17.

Figure 2:
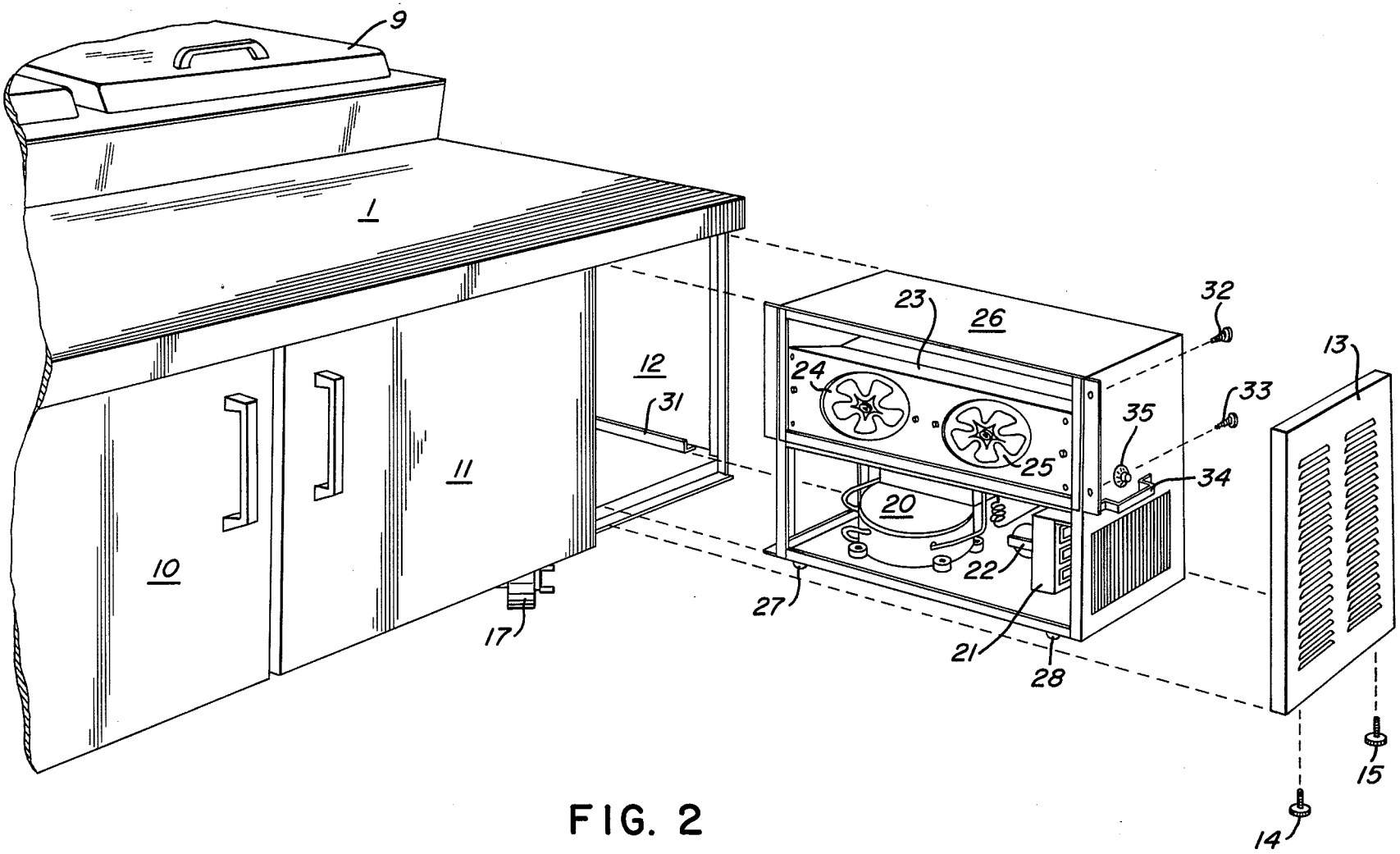
FIG. 2 is an exploded view in perspective of the unit of FIG. 1 showing the removable modular refrigeration unit.

In greater detail, the relationship of the modular refrigeration unit to the table is shown in FIG. 2. In this regard, the conventional elements of the refrigeration system, compressor 20, condenser 21, condenser fan 22, evaporator unit 23 and refrigerator blower fans 24 and 25 are all provided in the confines of the same modular unit 26, at the bottom of which are provided rollers, bearings or caster devices such as are shown at 27 and 28. The compressor, condenser and evaporator are suitably connected, with filter and dryer and meter means between the condenser and evaporator, to provide a standard refridgeration cycle with respect to the flow of a refrigerant fluid medium through the components in a manner which is known in the refrigeration art. A rail or other guide means for positively locating or securing the modular refrigeration unit within the equipment zone of the refrigerator may be provided to communicate with corresponding means included within the cabinet, such as the rail shown at 31. Vents, screening, louvers or other air flow permeable means are provided adjacent fans, blowers, or other circulation means as is conventional in refrigeration systems. The modular unit is held in place within the cabinet by securing means, such as the two screws shown at 32 and 33 although snap fasteners, pins or other securing devices may readily be substituted. Pull handle 34 of the front of the unit, as well as a conventional temperature control 35, appropriately located in the refrigeration cycle, are provided on the front facing side of the modular refrigeration unit.

Figure 3:
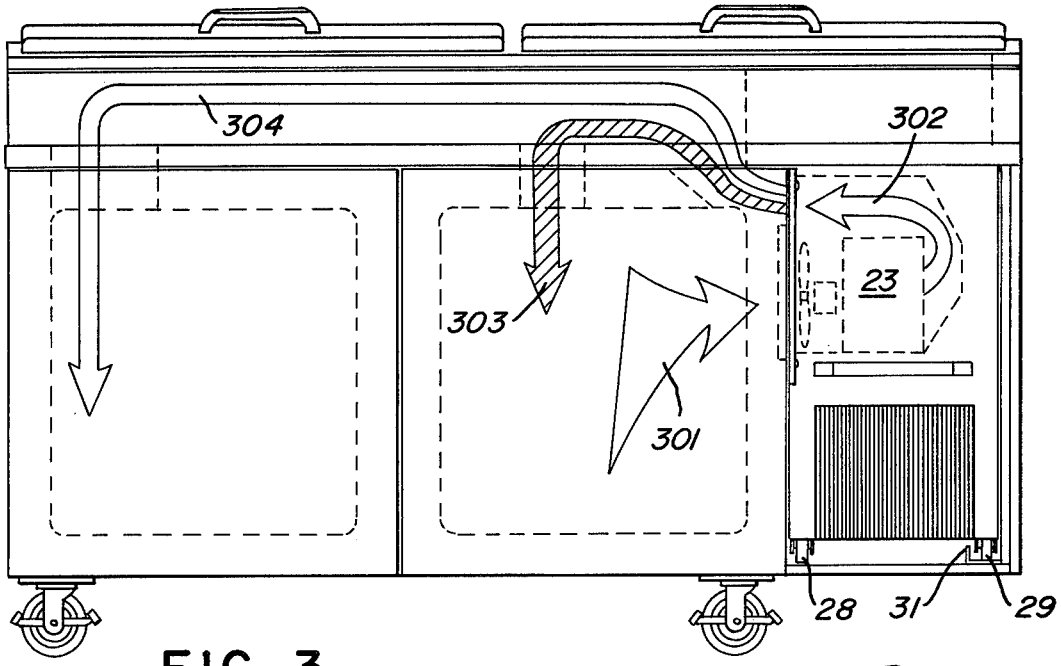
FIG. 3 is an elevational front view of the refrigerator table of FIG. 1.

In the front elevation view of FIG. 3, shown with front panel 13 removed, the relationship of rollers 28 and 29 of the modular unit to guide means 31 of the cabinet and the relationship of the modular refrigeration unit, including the frontal view of the flow of refrigerated air through the unit, with respect to the overall system is shown. In this regard, a first volume of air 301 from the refrigeration zone of the cabinet is blown by evaporator fans 24, and 25 (only one of which is shown for purposes of clarity) through the evaporator unit 23 where the temperature of the air is to be maintained at a predetermined controlled level in accord with principles of the refrigeration art. After passing through the evaporator, the refrigerated air flow stream 302 enters a duct means in the food zone of the cabinet where the stream is divided into two portions 303 and 304 which are respectively directed by further duct means into a first refrigerator cabinet zone and to a second condiment tray zone of the cabinet. The outlet of the duct directing initial air flow to the refrigerator cabinet zone should be spaced a lateral distance away from the evaporator inlet duct of the modular refrigeration unit. Typically, a distance of approximately 25 percent of the length of the refrigerator cabinet zone from the evaporator inlet duct is a suitable spacing. Condiment tray air stream 304 is in turn directed to the refrigerator cabinet zone by further duct means after traverse along the length of, at the underside of the tray in the enclosed space formed thereby. The condiment tray zone and refrigerator cabinet zone are separated by insulating means, except for the ducts which provide the respective air flows thereto.

Figure 3A:
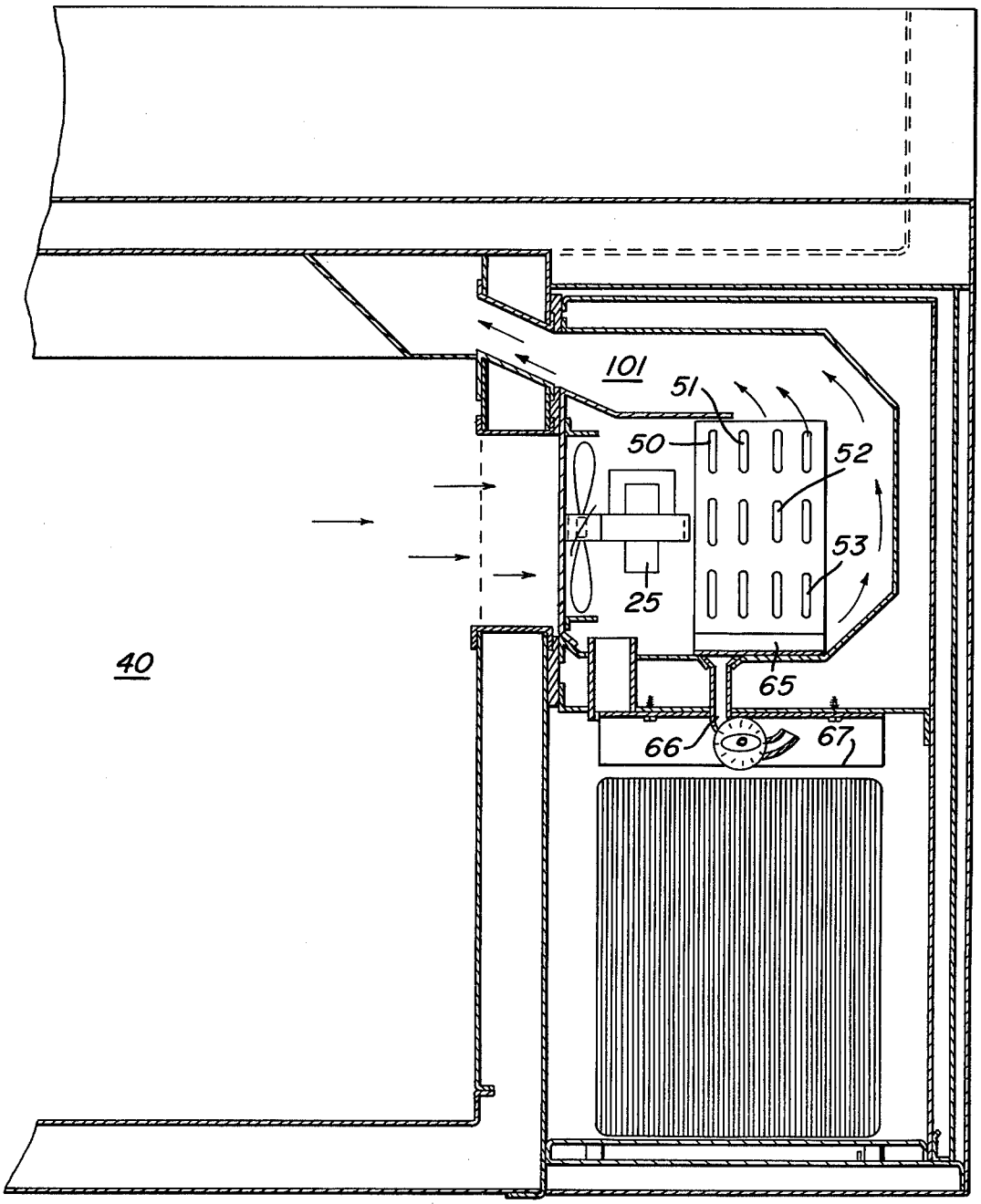
FIG. 3A is a detailed sectional view of the refrigerator elements shown in FIG. 3.

More particularly, FIG. 3A depicts cross-sectional air flow through the refrigeration unit with respect to the relationship of fluid air flow in the refrigeration zone. In this regard, it can be seen that fan 25 pulls in air from the refrigerator cabinet zone 40 and passes the air through typical finned, serpentine evaporator coils, such as are shown at 50–53 contained within evaporator unit where the air is cooled. The cooled air is then deflected, by the duct means, upwardly and then laterally, changing direction 180°, to reach the refrigerated air outlet of the modular refrigeration unit indicated by 101.

Figure 4:
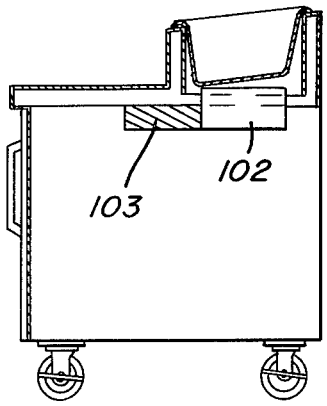
FIG. 4 is a cross-section elevational view of the unit taken through Section 4—4 of FIG. 1.
Figure 5:
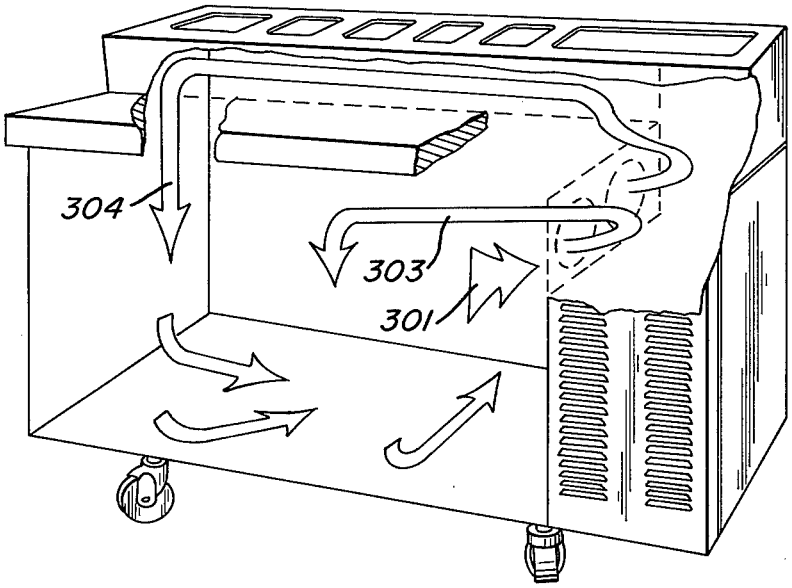
FIG. 5 schematically represents air circulation and recirculation through the unit in cyclical fashion.

The refrigerated air from the modular refrigeration unit is then directed in further duct means contained within the refrigerator cabinet to the various refrigeration zones of the foodstuff containing compartments of the refrigerator cabinet. In a side cross-section, such means is shown in FIG. 4 in which the entrance of a larger duct 102 is provided to direct the flow of refrigerated air as it exits from the modular refrigeration unit to a first location at the underside of the condiment tray in the first refrigeration zone of the refrigerator unit. The entrance of a smaller duct adjacent thereto, 103, directs a lesser proportion of the refrigerated air flow from the modular refrigeration unit into a second refrigeration zone of the refrigerator unit, which in this instance is a typical refrigerator compartment for the storage of foodstuffs in an enclosed space. The outlet for the first duct means provided to cool the underside of the upper condiment tray is provided at the opposite side of the cabinet where the circulating air flow is then further directed downwardly into the refrigerator cabinet compartment. Typically, in a pizza, salad, or sandwich preparation table the proportion of refrigerated air flow directed intially to the condiment zone is approximately 60% to 80% of capacity with the remaining 40% to 20% directed to the refrigerator compartment zone. The recirculating cycle of air flow within the unit with respect to fluid flow within the refrigerator zones and through the evaporator coil of the modular refrigeration unit is further schematically represented in FIG. 5.

Figure 6:
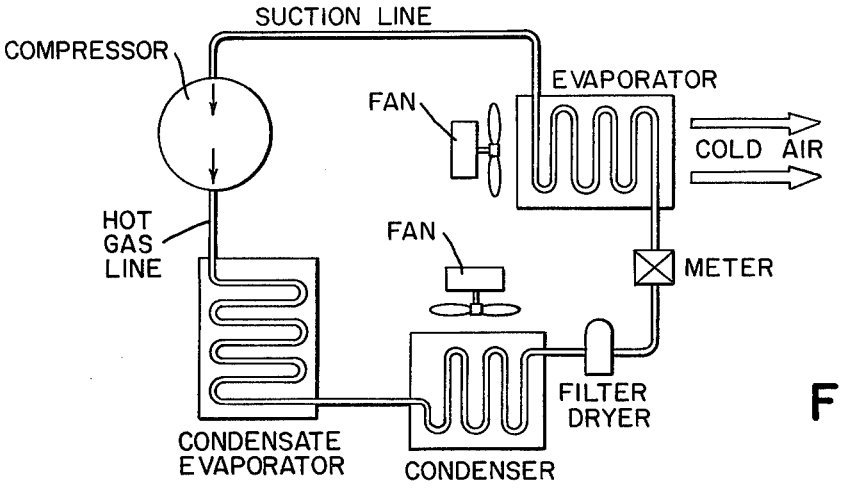
FIG. 6 is a flow chart of the refrigeration system of the invention.

The refrigeration system of the modular unit also uses the hot gas tubing of the refrigeration system as the condensate evaporator in conjunction with heat emanating from the compressor. In this regard, with reference to FIG. 3A, it can be seen that the evaporator coil, above the condenser, is separated by insulation from the other refrigeration system equipment. Beneath the evaporator, a pan 65 is provided to collect condensation drippings which may be produced and the pan in turn is provided with a drain 66 including an integral water trap which seals the evaporator compartment from the lower portion of the equipment zone. As condensate collects, the trap overflows, directing water to condensate evaporator pan 67 which is located above the condenser unit. The pan is heated by the hot gas line of the refrigerator unit. As the hot gas line leaves the compressor, it is coiled in serpentine fashion and bonded to the condensate evaporator pan where heat is provided. The serpentine coil of the condensate evaporator may be on either top or bottom side of the pan and the addition of heat from the condenser to the heat provided by the hot gas line evaporates such condensate as may be produced during operation of the unit. In this regard, a flow chart of refrigeration fluid through the system, showing the relationship of the condensate evaparator, intermediate the compressor and condenser in the refrigeration cycle, is depicted in FIG. 6.

The advantages and utilities of the system are represented by the following examples:

EXAMPLE I

A standard sized 60" two door pizza and sandwich preparation table is constructed in a configuration corresponding to FIGS. 1–3. Nominal design temperature for the refrigerator is 38° F. A one-third horsepower single phase motor compressor is provided in conjunction with a suitable condenser fan motor (1/125 horsepower) and a metering device such as 0.055 inch internal diameter capillary tubing or a thermal expansion valve such as a commercially available "Sporlon" Model GF-$\frac{1}{4}$-C. Finned, serpentine coil evaporator and condenser are provided in conventionally sized configurations in the form as depicted in FIGS. 2 and 3A. The two evaporator fan motors are each rated at 128 cubic feet per minute. Beneath the evaporator coils, there is provided a die cast or sheet metal pan for the collection of condensate, and the pan is in turn heated by a serpentine coil of the hot gas return line of the refrigeration system in contact therewith. The total volume allocated in the overall unit to the modular refrigeration system is comparable to the space allocation in conventional systems. In contrast with prior art configurations, however, the elimination of the evaporator and blower fans from the refrigeration space increases effective storage volume within the refrigerator cabinet by at least one cubic foot in the approximately 15 cubic foot storage area of the cabinet. In addition, the need for a separate fabricated metal body and shroud to house the evaporator and blower fans in the refrigerator cabinet food zone is also eliminated. The lengths of tubing connecting to the compressor and condenser to the other components of the refrigeration system, in the refrigeration cycle, is minimized. Similarly, the recirculating ducts which provide the refrigerated air throughout the zones of the unit permit the elimination of secondary air circulation fans which are customarily provided in prior art units, resulting in savings of additional space in the refrigeration cabinet, as well as reducing component, manufacturing and operating costs. In utilizing the hot gas line of the refrigeration systems in combination with the compressor/condenser heat to evaporate condensate, 160 watts of power use for 24 hours per day in continuous use is conserved.

Should such a cabinet be desired in a longer, three door version, additional duct means may be provided at the upper portion of the refrigerator cabinet zone to equalize air circulation in the unit. Similarly, a bank of units may be provided, alternating the modular refrigeration systems, connected by ducts, with cabinet zones for foodstuff refrigeration.

It is apparent that first time assembly and component costs of the unit are considerably reduced, and operating savings are achieved, in addition to realizing the salutary advantages of the invention as set forth in the objects section of this specification.

EXAMPLE II

A franchise operation in a locality requires standardized refrigerator units at multiple locations in separate installations throughout a locality. The refrigeration units are adapted to be used as salad tables, storage cabinets, preparation tables and the like. Each refrigerator unit is provided with a same modular refrigeration system. Equipment service within the franchise system is centralized since each modular refrigeration unit is interchangeable with another. In the event of breakdown, a master spare is provided while the original unit is serviced at a central location. The need for on site repair of the refrigeration system in its commercial environment is avoided.

While the preferred embodiment of the invention with respect to a preparation table having a condiment tray has been specifically described, it is evident that the duct/recirculating air system of the invention in conjunction with the modular refrigeration unit may be adapted to refrigerator cabinets for other uses and applications. Capacities of the appropriate components will be suitably scaled in accord with principles of the art. The salutary advantages of the systems are similarly realized in such other applications.

What is claimed is:

1. A foodstuffs refrigerator comprising an integral cabinet having at least two zones in separate compartments including:

a. a confined food zone in a first compartment in which foodstuffs are to be located and within which zone a controlled refrigeration temperature is maintained and which zone is free of mechanical equipment; and, b. a separate equipment zone in a separate compartment adjacent to the food zone containing a modular refrigeration unit which is independently removeable from the compartment of the equipment zone and which unit provides the controlled temperature for the food zone; said modular refrigeration unit integrally including compressor, condenser, evaporator, metering means and means for connecting said components in the relationship of a refrigeration cycle, and an air circulating means to provide a flow of air to and from the evaporator means of the refrigeration unit;

and in which the food zone and equipment zone are connected by duct means between the two compartments for directing the flow of air provided from the air circulating means of the modular refrigeration unit contained within the equipment zone to a predetermined area of the food zone, and for directing a flow of air from the food zone to the air circulating means, whereby air is recirculated from the food zone through the evaporator means of the refrigeration unit in a cyclical manner.

2. A food preparation table in accordance with claim 1 in which in the food zone a refrigerated condiment tray is included at the top portion of the table and in which a refrigerator cabinet is included beneath the condiment tray and in which a duct means is provided to divide the flow of circulating air from the refrigeration unit (1) to direct a first principal portion of circulating air to the underside portion of the condiment tray and thereafter to the refrigerator cabinet and (2) to direct a second minor portion of the circulating air to the refrigerator cabinet.

3. The food preparation table of claim 1 or of claim 2 in which a condensate evaporator is additionally provided in the modular refrigeration unit, said condensate evaporator including a means for the collection of condensate from the circulating aid and further means for directing said condensate for evaporation to a tray heated at least by the hot gas return line of the refrigeration cycle.

4. A system of standardized refrigerator units utilized at multiple installations at separate locations in which each refrigerator unit contains separate compartments which define a first food zone which is free of mechanical equipment and a second equipment zone in which the refrigeration system of each unit is contained within the equipment zone and is separately removeable from the refrigerator unit and interchangeable with the refrigeration system of other units, and in which the refrigeration system of each unit integrally includes in a standardized module, a compressor, condenser, evaporator and metering means connected together in a refrigeration cycle for providing a controlled refrigeration temperature, and circulating means for providing a flow of fluid air to the evaporator means, to provide a controlled refrigeration temperature to the fluid air, and in which the refrigeration system of the unit is engageable with duct means for connecting the flow of fluid air provided by the circulating means to the food zone within a refrigerator unit.

* * * * *